US010253448B2

(12) United States Patent
Bison et al.

(10) Patent No.: US 10,253,448 B2
(45) Date of Patent: Apr. 9, 2019

(54) LAUNDRY DRYER AND METHOD OF OPERATING A LAUNDRY DRYER

(71) Applicant: Electrolux Appliances Aktiebolag, Stockholm (SE)

(72) Inventors: Alberto Bison, Pordenone (IT); Nicola Reid, Budoia (IT); Giuseppe Rossi, Porcia (IT)

(73) Assignee: Electrolux Appliances Aktiebolag (SE)

( * ) Notice: Subject to any disclaimer, the term of this patent is extended or adjusted under 35 U.S.C. 154(b) by 353 days.

(21) Appl. No.: 14/892,775

(22) PCT Filed: May 24, 2013

(86) PCT No.: PCT/EP2013/060811
§ 371 (c)(1),
(2) Date: Nov. 20, 2015

(87) PCT Pub. No.: WO2014/187506
PCT Pub. Date: Nov. 27, 2014

(65) Prior Publication Data

US 2016/0115643 A1 Apr. 28, 2016

(51) Int. Cl.
*D06F 58/24* (2006.01)

(52) U.S. Cl.
CPC ..... *D06F 58/24* (2013.01)

(58) Field of Classification Search
CPC ..... D06F 58/22; D06F 58/24; D06F 58/206
See application file for complete search history.

(56) References Cited

U.S. PATENT DOCUMENTS 4,621,438 A * 11/1986 Lanciaux ..... D06F 58/04 34/242
2010/0083532 A1 4/2010 Klug et al.
2011/0302967 A1 12/2011 Grunert et al.

FOREIGN PATENT DOCUMENTS

CN 1724795 A 1/2006
DE 4300694 A1 7/1994
(Continued)

OTHER PUBLICATIONS

Chinese Office Action dated Mar. 27, 2017 in related Chinese Application No. 201380076786.9.
(Continued)

*Primary Examiner* — Jessica Yuen
(74) *Attorney, Agent, or Firm* — RatnerPrestia

(57) ABSTRACT

A laundry dryer (2) has a casing, a laundry storing compartment (18) arranged within the casing for receiving laundry (19) to be dried by passing process air (A) through the laundry storing compartment (18), and a heat exchanger (10) for dehumidifying the process air (A) after passing the laundry storing compartment (18). Furthermore, the dryer (2) has a condensate collecting device (30) for collecting condensate formed at the heat exchanger (10), and a removable condensate reservoir (40) for storing condensed water formed at the heat exchanger (10). Moreover, the dryer has a control unit (42) for controlling the operation of the laundry dryer (2), and a pumping and feeding arrangement (36) for pumping condensate collected in the condensate collecting device (30) through an internal line (38) to the removable condensate reservoir (40). The pumping and feeding arrangement (36) is fluidly connected to a draining line (39) for pumping condensate collected in the condensate collecting device (30) selectively through said internal line (38) and/or through said draining line (39). The draining line (39) is adapted to be selectively connected to an external
(Continued)

sink for discharging the condensate outside the dryer casing or to the removable condensate reservoir (40) to supply the condensate pumped through the draining line (39) to the removable condensate reservoir (40).

23 Claims, 8 Drawing Sheets

(56) References Cited

FOREIGN PATENT DOCUMENTS

| | | | |
|---|---|---|---|
| DE | 102007049060 | A1 | 4/2009 |
| DE | 102009001548 | A1 | 9/2010 |
| DE | 102010002661 | A1 | 9/2011 |
| EP | 1186697 | A2 | 3/2002 |
| WO | 2009050003 | A1 | 4/2009 |

OTHER PUBLICATIONS

International Search Report dated Feb. 26, 2014 in corresponding International Application No. PCT/EP2013/060811.

* cited by examiner

LAUNDRY DRYER AND METHOD OF OPERATING A LAUNDRY DRYER

The invention relates to a laundry dryer comprising a pumping and feeding arrangement for pumping condensate collected in a condensate collecting device through an internal line to a removable condensate reservoir. Furthermore, the invention relates to a method of operating such a laundry dryer. Furthermore, the invention relates to a laundry dryer comprising a cleaning arrangement adapted to supply condensate to a component of the dryer for removing lint.

BACKGROUND

WO 2009/050003 A1 discloses a heat pump dryer whose heat exchanger is cleaned from lint using rinsing liquid. The rinsing liquid is condensed water stored in a rinse container within a removable condensate reservoir. The condensate is pumped from a condensate collecting device to the removable condensate reservoir by a pumping and feeding arrangement having a pump and a valve. The pump and the valve are controlled by a control unit. The valve comprises two outlets—one outlet for connecting an internal line and a second outlet for connecting a draining line. The internal line is fluidly connected to the removable condensate reservoir. The draining line is fluidly connectable to an external waste water system, if existing. After rinsing the heat exchanger, the remaining rinsing liquid and stored condensate can be guided by the draining line into the external waste water system. Thus, a manual exhausting the removable condensate reservoir is avoided. If said external waste water system does not exist, the draining line has no function. The preconditions for using this known draining line are: connecting the draining line to an external waste water system, external sink or the like, and manually operating an operation unit serving as an input panel to the control unit. Depending on the manual operation of said operation unit the pumping and feeding arrangement is capable to pump the condensate from the condensate collecting device selectively through the internal line to the rinse container of the removable condensate reservoir (during the rinsing process) and through the draining line to the external waste water system (after the rinsing process).

SUMMARY OF SELECTED INVENTIVE ASPECTS

It is an object of the invention to provide a laundry dryer and a method of operating a laundry dryer further improving user convenience.

According to aspects of the invention, a laundry dryer comprises a casing and a laundry storing compartment arranged within the casing for receiving laundry to be dried by passing process air through the laundry storing compartment. A heat exchanger is arranged for dehumidifying the process air after passing the laundry storing compartment. The heat exchanger is forming or generating condensate or condensed water which is collected in a condensate collecting device of the dryer. Moreover, the laundry dryer comprises a control unit for controlling the operation of the dryer.

Further, the dryer comprises a removable condensate reservoir for storing condensate generated at the heat exchanger. A pumping and feeding arrangement is disposed within the dryer casing for pumping condensate collected in the condensate collecting device through an internal line to the removable condensate reservoir. The pumping and feeding arrangement is additionally fluidly connected to a draining line. The pumping and feeding arrangement is thus adapted for pumping condensate collected in the condensate collecting device selectively through the internal line and/or through the draining line.

The draining line as such is adapted to be selectively connected to one of the following destinations: to an external sink for discharging the condensate to the outside of the dryer casing, and to the removable condensate reservoir to supply the condensate pumped through the draining line to the removable condensate reservoir.

Thus, the draining line can be used in two different functions—depending on an existing external sink and/or the connection of the draining line established by the user. The draining line is user-connectable, i.e. the draining line can be selectively connected by the user to different destinations. This selectable usage of the draining line facilitates a user-optimized handling of the generated condensate and the draining line itself. In this regard, connecting the draining line to an external sink also includes disposing the outlet of the draining line at or into an external location (e.g. basin or sink).

Since the draining line is connected in any case by the user to the external sink or to the removable condensate reservoir, no detecting element (e.g. sensor or detector) is required for detecting whether the draining line is connected to the removable condensate reservoir or not. Furthermore, it is not required to make any additional user action (e.g. programming or initializing a control unit) in ensuring the condensate arriving at the destination determined by the user, thus allowing a user-optimized convenient handling of the generated condensate.

Since two independent and alternative lines (at least along a portion of their length) are permanently present and connected in any case it is ensured to offer permanently sufficient cleaning or rinsing liquid during a running program cycle and simultaneously to avoid any danger of water/condensate leakage. If a draining kit for draining condensate via the draining line to an external location (e.g. sink) is not present, the draining line remains connected to the removable condensate reservoir and therefore the condensate drained through the draining line is automatically pumped into the removable condensate reservoir.

The draining kit may comprise elements for guiding and/or mounting and/or extending the draining line when a user selects the draining line to connect its outlet to an external location.

By providing the connection system for the internal line and the draining line, a potential usage of the draining kit (draining line connected to external sink) does not influence the management of the condensate within the dryer during a drying cycle or any other program. Furthermore, due to the connection system it is not required to inform the dryer (e.g. initialization of a control unit by the user, specific software option etc.) about the presence of the draining kit. Rather, the user is not requested to change any software option and/or hardware switch to manage the draining kit status. Thus, a potential condensate leakage out of the dryer due to a user's mistake or bug in configuring a software is avoided.

The laundry dryer is a condenser dryer, preferably a heat pump tumble dryer.

Particularly, removing the removable condensate reservoir means that it can be extracted from and inserted into a reservoir compartment.

Preferably, a supply line for providing a cleaning liquid (e.g. generated condensate) to a component to be cleaned of the dryer is provided. This supply line inlet is fluidly connected particularly to a condensate receiving element of the dryer or to the removable condensate reservoir when the removable condensate reservoir is inserted in the reservoir compartment.

In a preferred embodiment the control unit is adapted to control the pumping and feeding arrangement such that during a single drying operation a portion of the condensate is pumped through the internal line and a portion of the condensate is pumped through the draining line. 'Adaption' of the control unit means that this function is implemented without any additional user action (e.g. programming or initializing the control unit). Rather, this function of the control unit can be implemented permanently. In this regard, the term 'portion' means a non-zero volume portion, i.e. during a single drying operation in any case the condensate is pumped through both lines. Preferably, the two condensate portions have a predefined volume ratio and/or are pumped at different time intervals or partially during the same time intervals.

Preferably, the dryer offers at least one drying program where condensate is pumped through both lines. Thus, the performance in removing or feeding the condensate is enhanced during such a drying program.

In an embodiment and during a normal drying program both lines are used for pumping condensate. However, in a special program (e.g. cloth refresh or dry cleaning with steam) there may be no need for condensate removal through the draining line. The condensed liquid essentially corresponds to the liquid used in the refreshment and/or steam cleaning process.

In a preferred embodiment the control unit is adapted to control the pumping and feeding arrangement such that

- at the end of a single drying operation a portion of the condensate, and/or
- during or at the end of a rinsing sequence for rinsing a component of the dryer, the condensate is pumped automatically (i.e. without any additional user action) through the draining line. Particularly, the condensate is pumped only through the draining line and not additionally through the internal line. Alternatively, in specific cases the condensate is pumped in two condensate portions through the internal line and the draining line, wherein the two condensate portions have a predefined volume ratio. When the draining line is connected to an external location (e.g. sink) this embodiment provides a safe outside-removal of the condensate without any additional user action (e.g. programming or initializing the control unit).

Preferably, the removable condensate reservoir is fluidly connected to a cleaning arrangement adapted to supply condensate to a component (e.g. heat exchanger, filter) of the laundry dryer for removing lint. Particularly, the cleaning arrangement is controlled by the control unit and the condensate is supplied under the control of the control unit.

Preferably, the dryer comprises a re-feed connecting element adapted for being connected to the outlet of the draining line for guiding the condensate pumped through the draining line into a or the removable condensate reservoir of the dryer. The draining line and the re-feed connecting element form a disconnectable line or a separable connection allowing the user to guide the condensate pumped through the draining line either to the external sink or towards the removable condensate reservoir (back into the dryer, if the draining line is at least partially guided at the outside of the dryer casing). This re-feed connecting element provides a simple handling of a detachable connection between the outlet of the draining line and the condensate reservoir. Furthermore, it offers a user-optimized connection interface between the draining line and other elements of the dryer.

Particularly, the re-feed connecting element comprises a manifold having a first inlet connected to the outlet of the internal line and a second inlet selectively connectable to the outlet of the draining line. Using such a re-feed connecting element as a fluid connection interface it is possible to dispose common types of a condensate receiving element, particularly the removable condensate reservoir, within the dryer's casing without considering several inlet regions for the draining line and the internal line. Rather, the sole inlet of a common condensate receiving element is sufficient for a fluid connection between both lines (if draining line is not externally connected) and the condensate reservoir.

In a preferred embodiment a non-return valve (check valve; operating without external control) or a valve (operating by external control, e.g. by the control unit) is arranged between the outlet of the internal line and the first inlet. Alternatively or additionally, a non-return valve or a valve is arranged between the outlet of the draining line and the second inlet of the re-feed connecting element. The non-return valve(s) or the valve(s) prevent return of condensate at the internal line's or draining line's outlet via the adjacent line back to the non-movable condensate collecting device.

Preferably, a valve is provided having a fluid connection between both lines (the internal line and the draining line) and the removable condensate reservoir. In this regard, the outlet of the internal line is connected to this valve and the outlet of the draining line is selectively connected to this valve, wherein the outlet of this valve is connected to the removable condensate reservoir.

In a further embodiment a re-feed connecting element or the re-feed connecting element comprises a connector or a stub configured for mounting the outlet of the draining line to this connector or stub. Such a connector or stub offers a time-saving assembling aid when the draining line is selected to guide condensate into a condensate receiving element, particularly into the removable condensate reservoir.

In further embodiments a re-feed connecting element or the re-feed connecting element or a portion thereof is arranged in at least one of the following locations of the dryer's casing:

- at an outside wall,
- at the backside of the casing,
- in a receptacle of the casing, and
- behind a removable cover arranged at an outside wall of the casing.

Preferably, the portion of the re-feed connecting element is constituted by a connector or stub of the re-feed connecting element. This arrangement of the re-feed connecting element and particularly of its connector or stub provides a user-optimized handling of the draining line, when the draining line is selected to be fluidly connected to a condensate receiving element, particularly to the removable condensate reservoir.

Preferably, a or the re-feed connecting element comprises a through-hole adapted to receive an end section of the draining line. This end section comprising the draining line's outlet can be easily pushed into the through hole to make a safe fluid connection between the draining line and the re-feed connecting element. This design can be made as an alternative solution to said connector or stub. Particularly, the through-hole is ending at a liquid guide for guiding the condensate pumped through the draining line to the removable condensate reservoir. This liquid guide supports a safe condensate guidance within a or the re-feed connecting element.

Preferably a or the re-feed connecting element comprises one or more mounting elements (e.g. clamps) for selectively or removably fixing the draining line in a predefined position for guiding the condensate pumped through the draining line into or towards the removable condensate reservoir.

In a further embodiment a or the re-feed connecting element comprises a feeding line having an inlet and an outlet. The inlet is arranged particularly at an outer wall of the dryer's casing or adjacent to said outer wall. Such an arrangement of the feeding line provides a space-saving design of the re-feed connecting element between the draining line and the removable condensate reservoir. Preferably, the inlet of the feeding line is connected to the outlet of the draining line and the outlet of the feeding line has a fluid connection with an inlet of the removable condensate reservoir. Arranging a feeding line having such an outlet permits locating a fluff filter at the outlet of the feeding line or at the inlet of the removable condensate reservoir thus presenting a simple construction for cleaning the condensate from fluff before the condensate pumped through the draining line is entering the removable condensate reservoir.

In a preferred embodiment, when the outlet of the draining line is connected to a or the re-feed connecting element, the flow path of the draining line and the flow path of the internal line are arranged and/or guided in parallel to an inlet of the removable condensate reservoir or they are arranged at least fluidly in parallel to an inlet of the removable condensate reservoir. This offers a space-saving arrangement of both lines at the dryer's casing.

According to other aspects, a laundry dryer comprises a casing and a laundry storing compartment arranged within the casing for receiving laundry to be dried by passing process air through the laundry storing compartment. A heat exchanger is arranged for dehumidifying the process air after passing the laundry storing compartment. The heat exchanger is forming or generating condensate or condensed water which is collected in a condensate collecting device of the dryer. The dryer also comprises a control unit for controlling the operation of the laundry dryer.

Furthermore, this dryer comprises a draining line to discharge condensate to the exterior of the dryer casing and it comprises a pumping and feeding arrangement for pumping condensate collected in the condensate collecting device through the draining line. This pumping and feeding arrangement further is fluidly connected to an internal line. The pumping and feeding arrangement is adapted for pumping condensate collected in the condensate collecting device selectively through the draining line and/or through the internal line.

The control unit of this dryer is adapted to control the pumping and feeding arrangement such that during a single drying operation a portion of the condensate is pumped through the internal line and a portion of the condensate is pumped through the draining line. In this regard, the term 'portion' means a non-zero volume portion, i.e. during a single drying operation in any case the condensate is pumped through both lines. The dryer comprises at least one drying program where condensate is pumped through both lines. Thus, the performance in removing or feeding the condensate is enhanced during such a drying program. Particularly, during the at least one drying program (which may be the 'normal' or 'standard' drying program) both lines are used for pumping condensate. However, in a special program (e.g. cloth refresh or dry cleaning with steam) it may not be required to remove condensate through the draining line.

Since the internal line of the dryer is fluidly connected to a cleaning arrangement for removing fluff from a component of the dryer, this internal line can be also denoted as a 'cleaning line'. The fluff is removed from the component by rinsing or cleaning or washing this component. Preferably the laundry dryer is a condenser dryer, more preferably a heat pump tumble dryer.

Preferably the dryer comprises a condensate reservoir/tank for storing condensate therein. The condensate reservoir/tank can be arranged removably with respect to the dryer casing (e.g. extractable from the dryer's casing by a user) or can be fixedly arranged within the dryer's casing.

In a preferred embodiment the dryer does not comprise a condensate reservoir/tank—neither removable nor fixedly arranged at the dryer's casing. When there is no removable condensate reservoir/tank there is no need for the user to consider any action in order to keep an accurate dryer status after a drying or rinsing or cleaning operation. Avoiding even a fixedly arranged condensate reservoir/tank offers a space-saving design.

Preferably, the cleaning arrangement comprises a condensate receiving element for temporarily storing condensate therein. This stored condensate is used in a component cleaning cycle for cleaning the component. Thus, condensate can be provided at different times for a cleaning cycle even if the pumping and feeding arrangement is not active.

Alternatively, it is suggested to provide a space-saving cleaning arrangement by avoiding temporary condensate storage therein. Rather, in this embodiment the internal line (or cleaning line) is guiding the condensate to the component to be cleaned without temporary storing the condensate or without providing temporary condensate storage in the flow-path between the pumping and feeding arrangement and the component to be cleaned. The condensate can for example be pumped from the sump collecting the condensate condensed at the heat exchanger—such that the sump is acting as temporary condensate storage.

In further embodiments the dryer component to be cleaned by the condensate is at least one of the following elements: a heat exchanger, an evaporator, a fluff filter, and a process air channel section.

In a preferred embodiment at least one of the following elements of the dryer comprises a valve: the internal line, the draining line, and the re-feed connecting element.

For example, the internal line and the draining line each comprises a valve and/or the internal line and the re-feed connecting element each comprises a valve.

In an embodiment the term 'comprising a valve' means that the valve is associated (detachable or non-detachable) to the re-feed connecting element.

The used valve(s) can be arranged such that a simple construction is offered to avoid potential backflow of condensate to the pumping and feeding arrangement. The valve is constituted particularly as a non-return valve thus supporting a simple technical solution with regard to the desired avoidance of a potential condensate backflow.

In a further embodiment the pumping and feeding arrangement comprises two pumps. A first pump is connected to the internal line for pumping condensate from the condensate collection device through the internal line. The second pump is connected to the draining line for pumping condensate from the condensate collection device through the draining line. Using these two pumps, there is no need for additional specific technical elements (e.g. one or more valves) to permit a controlled condensate flow through both lines in case extend separately to their destination location, respectively (e.g. a condensate receiving element, removable condensate tank, external sink).

In another embodiment the pumping and feeding arrangement comprises a pump connected to the inlet of a valve. A first outlet of this valve is connected to the internal line and a second outlet of this valve is connected to the draining line. Using such a valve design, the pumping and feeding arrangement is allowed to comprise one sole pump. This embodiment is advantageous in case a space-saving location is necessary for locating the pumping and feeding arrangement.

Preferably, at least a portion of the internal line is guided external to an outer wall or rear wall of the dryer's casing. Alternatively or additionally, at least a portion of the draining line is guided external to an outer wall or rear wall of the dryer's casing. Thus, the respective line is available for a facile handling by the user.

According to an embodiment the control unit is adapted to determine when the removable condensate reservoir is full or nearly full with condensate. This determining may be made by a level detector assigned to the removable condensate reservoir and/or by a level sensor assigned to the condensate collecting device and the fact that the pumping and feeding arrangement is pumping for more than a predetermined time condensate to the removable condensate reservoir (e.g. when the removable condensate reservoir is full, the condensate flows back to the condensate collecting device). When it is determined that the removable condensate reservoir is full, a sub-routine for pumping condensate from the condensate collecting device through the draining line is activated. Then it is determined whether by the sub-routing an outside draining through the draining line can be effected. This is for example determined by detecting that the level in the condensate collecting device is decreasing. If it is determined that no outside draining can be effected the running drying or refreshment cycle is stopped. And if it is determined that the outside draining can be effected the running drying or refreshment cycle is continued. Thereby, if a connection to the external sink exists, the condensate can be drained thereto and the dryer needs not to be stopped.

Any of the above embodiments is applicable individually or in any (sub-combination) to the method. Any method aspect or functionality described below is fully applicable individually or in any (sub-) combination to the dryer described above.

According to the method of operating a dryer, the dryer comprises a control unit for controlling the operation of the dryer and a pumping and feeding arrangement for pumping condensate collected in a condensate collecting device. In the operation, independent of any user input and during at least one drying program, the control unit controls the pumping and feeding arrangement such that a portion of the condensate collected in the condensate collecting device is pumped through an internal line to a removable condensate reservoir, and a portion of the condensate collected in the condensate collection device is pumped through a draining line. Draining through the draining line may be simultaneously with pumping through the internal line such that the respective portions are pumped simultaneously. And/or the or a portion through the internal line and the or a portion through the draining line may be pumped in a time-sequential manner each at a respective time period.

In dependency of a user fluidly providing the outlet of the draining line to an external condensate sink or fluidly connecting the outlet of the draining line to the removable condensate reservoir, the condensate pumped through the draining line is drained to the external condensate sink or into the removable condensate reservoir.

According to an embodiment of the method, when during a running drying or refreshment cycle it is determined that the removable condensate reservoir is full or the pumping and feeding arrangement is active longer than a predetermined time period or the level in the condensate collecting device is higher than a predetermined level for a predetermined time period, the condensate pumped by the pumping and feeding arrangement is passed (preferably exclusively) through the draining line. Then, if the level in the condensate collecting device is not falling down the predetermined level or a second predetermined level within a second predetermined time period, the drying or refreshment cycle is stopped.

Preferably the method is implemented at a dryer comprising a control unit for controlling the operation of the dryer and a pumping and feeding arrangement for pumping condensate collected in a condensate collecting device. The pumping and feeding arrangement is fluidly connected to an internal line and to a draining line for pumping condensate through the internal line and/or the draining line.

Further preferably, the method of operating such a dryer includes the following features: The condensate pumped through the internal line is pumped to a removable condensate reservoir and the condensate pumped through the draining line is drained to an external condensate sink or into the removable condensate reservoir—depending on the following selection:

- the outlet of the draining line is fluidly connected to said external condensate sink, or
- the outlet of the draining line is fluidly connected to said removable condensate reservoir.

Particularly, the method is suitable for operating a dryer as described above. The laundry dryer is a condenser dryer, preferably a heat pump tumble dryer.

The term 'fluidly connecting the outlet of the draining line to an external condensate sink' does not mean necessarily a detachable joint connection between an outlet of the draining line and a connection element of the external sink. Rather, also disposing the outlet of the draining line at or into an external location (e.g. basin or sink) is regarded as a kind of connecting the draining line to an external location.

As the draining line is connected in any case, no detecting element (e.g. sensor or detector) is required for detecting a mechanical installation made by a user or which kind of fluid connection was selected by a user. Furthermore, it is not required to make any additional user action (e.g. programming or initializing a control unit) in ensuring a safe removal of the condensate, thus providing a user-friendly and convenient operation of the dryer.

According to a preferred embodiment (and independent of any user-input), the dryer is operated such that during at least one drying program the control unit controls the pumping and feeding arrangement such that a portion of the condensate collected in the condensate collecting device is pumped through the internal line to the removable condensate reservoir, and a portion of the condensate collected in the condensate collecting device is pumped through the draining line.

Particularly, during at least one of the user-selectable drying programs (e.g. a 'normal' drying program) both lines are used for pumping condensate. However, in at least one another user-selectable program (e.g. a special program like cloth refresh or dry cleaning with steam) no condensate removal through the draining line is required. Thus, the performance in removing or feeding the condensate is enhanced during such a drying program.

The term 'portion' means a non-zero volume portion, i.e. during a single drying operation in any case the condensate is pumped through both lines. Preferably, the two condensate portions have a predefined and/or permanent volume ratio.

Preferably, the outlet of the draining line is fluidly connected to the condensate receiving element via a re-feed connecting element in order to drain the pumped condensate via the re-feed connecting element into the condensate receiving element. This supports a simple handling of a detachable connection between the outlet of the draining line and the condensate receiving element.

In a preferred embodiment the pumping and feeding arrangement operates such that

- at the end of a single drying operation or at the end of a program, and/or
- during or at the end of a rinsing sequence for rinsing a component of the dryer the condensate is pumped automatically (i.e. without any additional user action) through the draining line. Particularly, the condensate is pumped only through the draining line and not additionally through the internal line. Alternatively, in specific cases the condensate is pumped in two condensate portions through the internal line and the draining line, wherein the two condensate portions have a predefined volume ratio.

Since in any case the outlet of the draining line is fluidly connected to an external sink or to the removable condensate reservoir, this operation offers a safe exhaustion of the condensate without any additional user action (e.g. programming or initializing the control unit). In a further embodiment the control unit controls a pump and a valve, or a first pump and a second pump, to selectively pump the condensate through the internal line and/or the draining line.

BRIEF DESCRIPTION OF THE DRAWINGS

Reference is made in detail to preferred embodiments of the invention, examples of which are illustrated in the accompanying figures which show.

DETAILED DESCRIPTION OF EXAMPLE EMBODIMENTS

Figure 1:
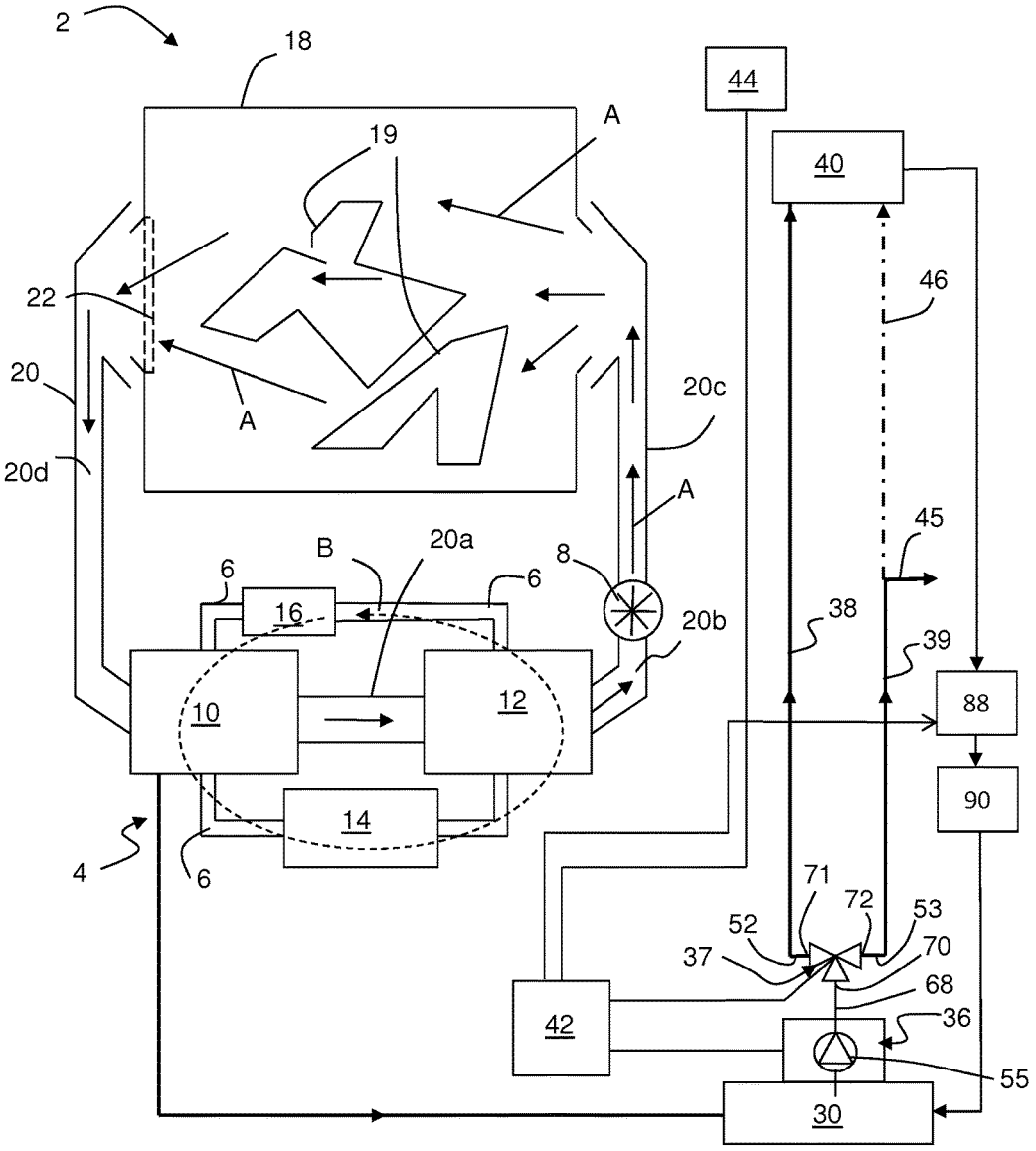
FIG. 1 a schematic view of components of a laundry dryer.

FIG. 1 shows a schematically depicted laundry dryer 2 which in this embodiment is a heat pump tumble dryer. The dryer 2 comprises a heat pump system 4, including a closed refrigerant loop 6 which comprises in the following order of refrigerant flow B: a first heat exchanger 10 acting as evaporator for evaporating the refrigerant and cooling process air, a compressor 14, a second heat exchanger 12 acting as condenser for cooling the refrigerant and heating the process air, and an expansion device 16 from where the refrigerant is returned to the first heat exchanger 10. Together with the refrigerant pipes connecting the components of the heat pump system 4 in series, the heat pump system forms the refrigerant loop 6 through which the refrigerant is circulated by the compressor 14 as indicated by arrow B.

The process air flow within the treatment apparatus 2 is guided through a compartment 18 of the dryer 2, i.e. through a compartment for storing articles to be treated, e.g. a drum 18. The articles to be treated are textiles, laundry 19, clothes, shoes or the like. The process air flow is indicated by arrows A in FIG. 1 and is driven by a process air blower 8. The process air channel 20 guides the process air flow outside the drum 18 and includes different sections, including the section forming the battery channel 20*a* in which the first and second heat exchangers 10, 12 are arranged. The process air exiting the second heat exchanger 12 flows into a rear channel 20*b* in which the process air blower 8 is arranged. The air conveyed by blower 8 is guided upward in a rising channel 20*c* to the backside of the drum 18. The air exiting the drum 18 through the drum outlet is filtered by a lint filter 22 arranged close to the drum outlet in or at the channel 20. The optional lint filter 22 is arranged in a front channel 20*d* forming another section of channel 20 which is arranged behind and adjacent the front cover of the dryer 2. The condensate formed at the first heat exchanger 10 is collected and guided to the condensate collecting device 30.

The condensate collecting device 30 is connected via a pumping and feeding arrangement 36, a diverter valve 37, an internal line 38 and optionally a draining line 39 to a removable condensate reservoir 40, i.e. the collected condensate can be pumped from the collecting device 30 to the removable condensate reservoir 40 which is arranged at an upper portion of the dryer 2 from where it can be comfortably withdrawn and emptied by a user. The removable condensate reservoir 40 can be extracted from and inserted into a reservoir compartment. As used herein, a 'diverter valve' is a valve having 3 paths—one inlet path and two outlet paths. Unless otherwise specified herein, the 'diverter valve' may be controlled by a control unit (42) to selectively open one of the outlets, to open or to close both outlets. Preferably the 'diverter valve' is a 3/2-way valve which is controllably opening one of the outlets and which preferably opens a predefined of the outlets if the valve is not activated (first opening NC, second opening NO).

The pumping and feeding arrangement 36 and the diverter valve 37 are controlled by a control unit 42. An operation panel 44 is connected to the control unit 42 in order to input program selections and program option selections as well as to indicate a program and/or dryer status to the user.

In FIG. 1 it can be seen that the internal line 38 and the draining line 39 (having the course as indicated by arrow 46) are fluidly connected to the pumping and feeding arrangement 36. Thus, the pumping and feeding arrangement 36 is able to pump condensate collected in the condensate collecting device 30 selectively through the internal line 38 and/or through the draining line 39. By a bold line 45 and a dashed line 46 it is indicated that the draining line 39 can selectively be connected to an external sink (see the bold line arrow 45 directed to an external location) or to the removable condensate reservoir 40 (see the dashed line arrow 46). When the draining line 39 is connected to the condensate reservoir, the condensate pumped through the draining line 39 is supplied to the condensate reservoir 40.

In general, the control unit 42 is adapted to control the operation of the dryer 2. Preferably, the control unit 42 is adapted to control the pumping and feeding arrangement 36 such that during a single drying operation a portion of the condensate is pumped through the internal line 38 and a portion of the condensate is pumped through the draining line 39. 'Single' means here that the control unit 42 is adapted to implement and execute at least one drying operation or sequence in which a portion is pumped through the internal line and another portion of the condensate is pumped through the draining line. In an embodiment the control unit 42 is adapted to control the pumping and feeding arrangement 36 such that the condensate is pumped (particularly only) through the draining line 39 at the end of a single drying operation or during or at the end of a rinsing sequence for cleaning or washing or rinsing a component of the dryer 2.

According to the first embodiment, the condensate pumped through the internal line 38 is always guided to the removable condensate reservoir 40, whereas the destination (external condensate sink or the condensate reservoir 40) of the condensate pumped through the draining line 39 depends on the connection for the draining line 39 as installed or manually connected by the user.

Figure 2:
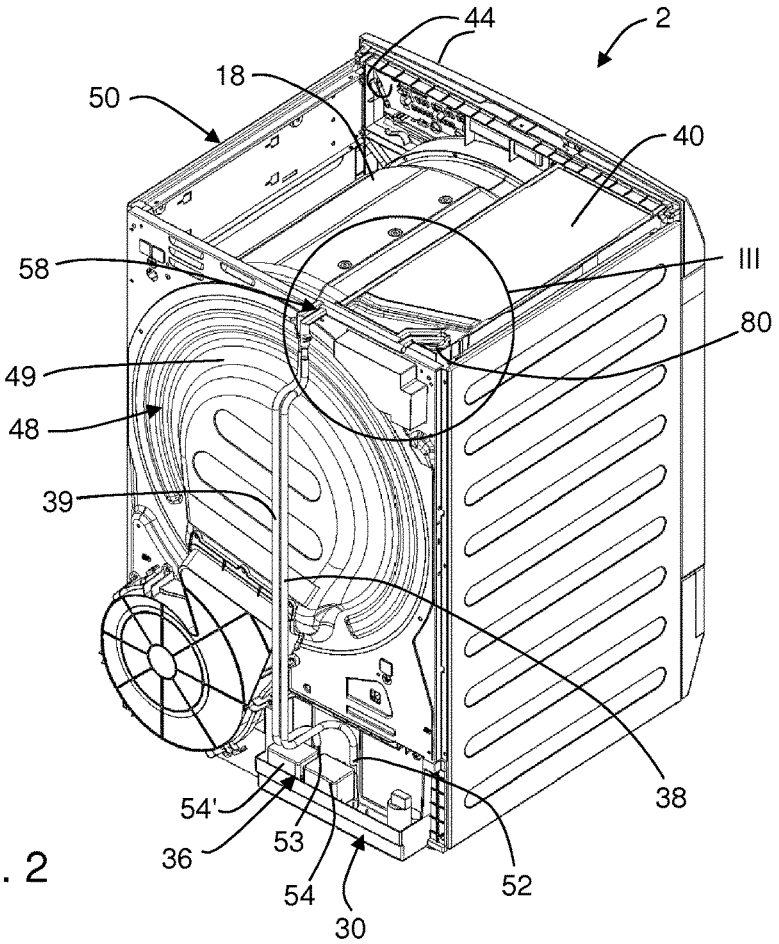
FIG. 2 a perspective view of the dryer showing its rear side, lateral side and top side, with an internal line and a draining line each connected to a removable condensate reservoir, FIG. 3 an enlarged view of the detail III in FIG. 2, FIG. 4 a perspective view of the dryer according to FIG. 2, but using a draining kit for connecting the draining line to an external location, FIG. 5 an enlarged view of the detail V in FIG. 4, FIG. 6 a perspective view of the dryer according to FIG. 2, showing a further embodiment of the internal line and the draining line each connected to a removable condensate reservoir, FIG. 7 an enlarged view of the detail VII in FIG. 6, FIG. 8 a perspective view of the dryer according to FIG. 6, but using a draining kit for connecting the draining line to an external location, FIG. 9 an enlarged view of the detail IX in FIG. 8, FIG. 10 a schematic view of a dryer, showing a connection system for an internal line and a draining line, FIG. 11 the schematic view of the dryer according to FIG. 10, but using a draining kit for connecting the draining line to an external location, FIG. 12 a schematic view of a dryer, showing a further embodiment of a connection system for an internal line and a draining line, FIG. 13 the schematic view of the dryer according to FIG. 12, but using a draining kit for connecting the draining line to an external location, FIG. 14 a schematic view of a dryer, showing a further embodiment of a connection system for an internal line and a draining line, FIG. 15 the schematic view of the dryer according to FIG. 14, but using a draining kit for connecting the draining line to an external location, FIG. 16 a schematic view of a dryer, showing a further embodiment of a connection system for an internal line and a draining line, FIG. 17 the schematic view of the dryer according to FIG. 16, but using a draining kit for connecting the draining line to an external location, FIG. 18 a schematic view of a dryer according to another embodiment, showing a further embodiment of a connection system for an internal line and a draining line, and FIG. 19 a flow diagram including a sub-routine for additional external draining or process interruption.

FIG. 2 shows an embodiment of a dryer 2 comprising one internal line 38 and one draining line 39. Both lines 38, 39 are arranged at the backside 48 of the dryer's casing 50. A line inlet 52 of the internal line 38 is connected to a first pump 54, while the line inlet 53 of the draining line 39 is connected to a second pump 54'. Both pumps 54, 54' are part of the pumping and feeding arrangement 36. Both lines 38, 39 are arranged for the most part in parallel. In a preferred embodiment, the condensate collecting device 30, the pumping and feeding arrangement 36 and at least a portion of the lines 38, 39 are covered and protected by a removable cover or an outside wall (not shown) arranged at the backside 48 of the casing 50.

Figure 3:
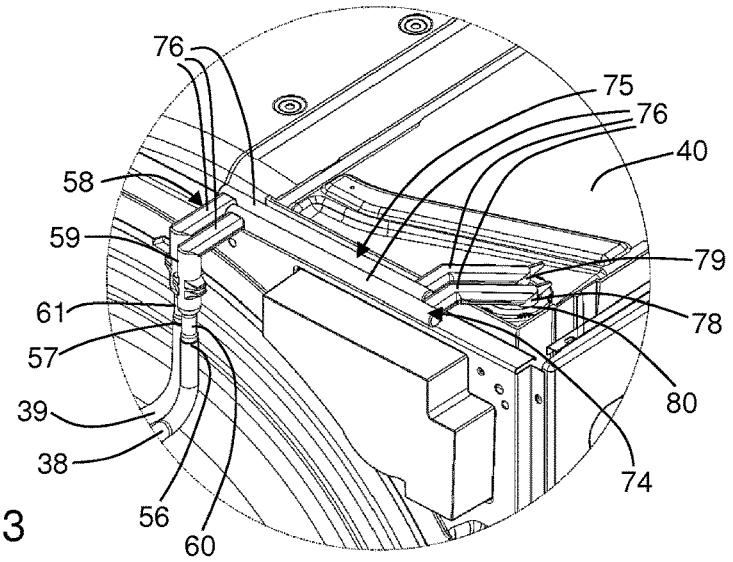

The outlet regions of the internal line 38 and the draining line 39 comprise a line outlet 56, 57, respectively (FIG. 3). The line outlets 56, 57 and at least an inlet region of a re-feed connecting element 58 are accessible by a user. Preferably, these parts are covered and protected by a removable cover (not shown) arranged at an outside wall of the casing 50. The user can remove such a cover or outside wall to have access to the line outlets 56, 57 and the re-feed connecting element 58. This element 58 is adapted for being connected to the line outlets 56, 57. For this purpose, the re-feed connecting element 58 comprises a manifold 59 having a first inlet 60 connected to the line outlet 56 of the internal line 38 and having a second inlet 61 selectively user-connectable to the line outlet 57 of the draining line 39.

According to the connection system with regard to the draining line 39, this line 39 is selectively connected by the user

Figure 5:
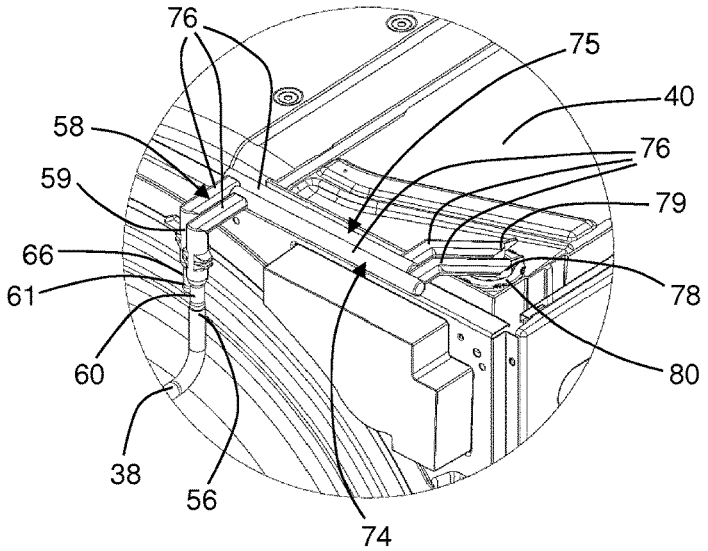
Figure 6:
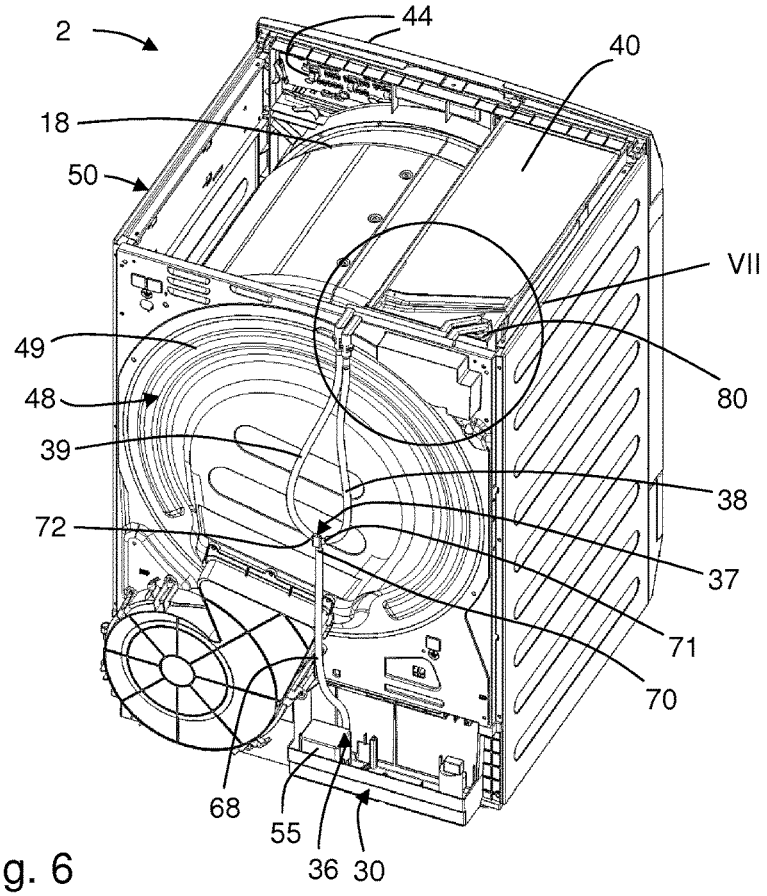
Figure 7:
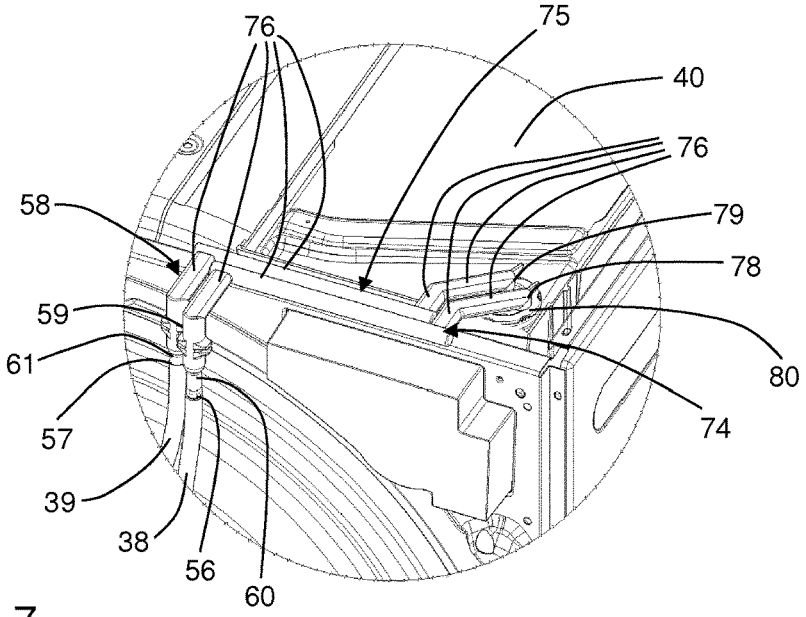
Figure 8:
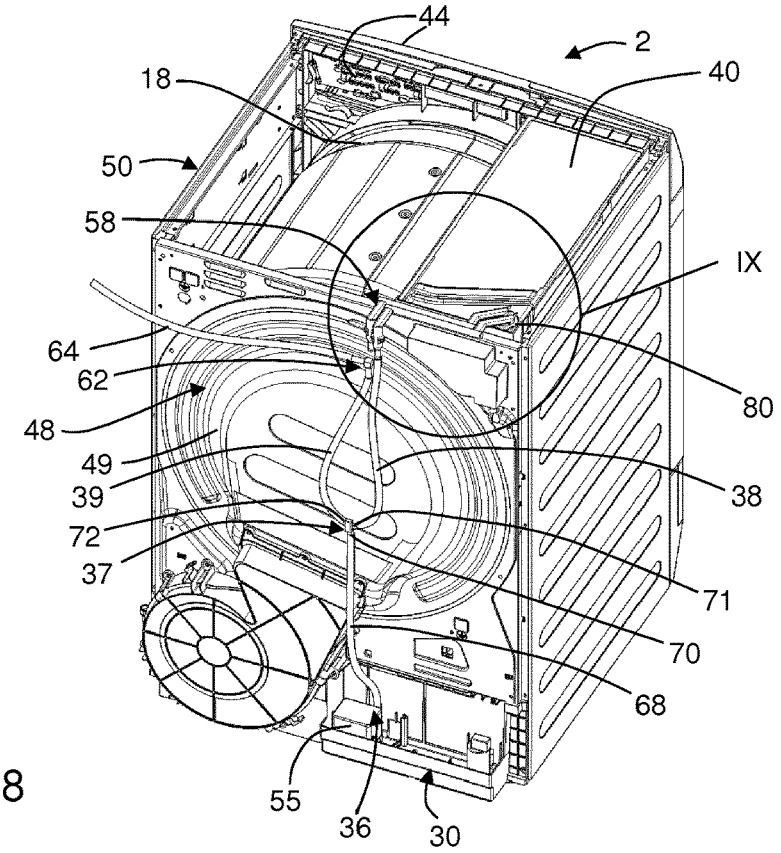
Figure 9:
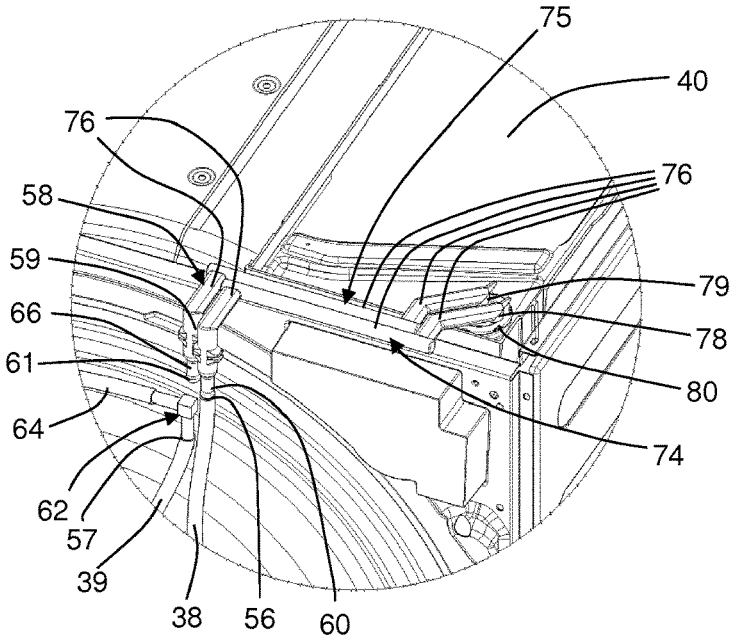

- to the removable condensate reservoir 40 (FIG. 2, FIG. 3; FIG. 6, FIG. 7), or
- to an external sink (not explicitly shown) for discharging the condensate outside the dryer casing 50 (FIG. 4, FIG. 5; FIG. 8, FIG. 9).

Figure 4:
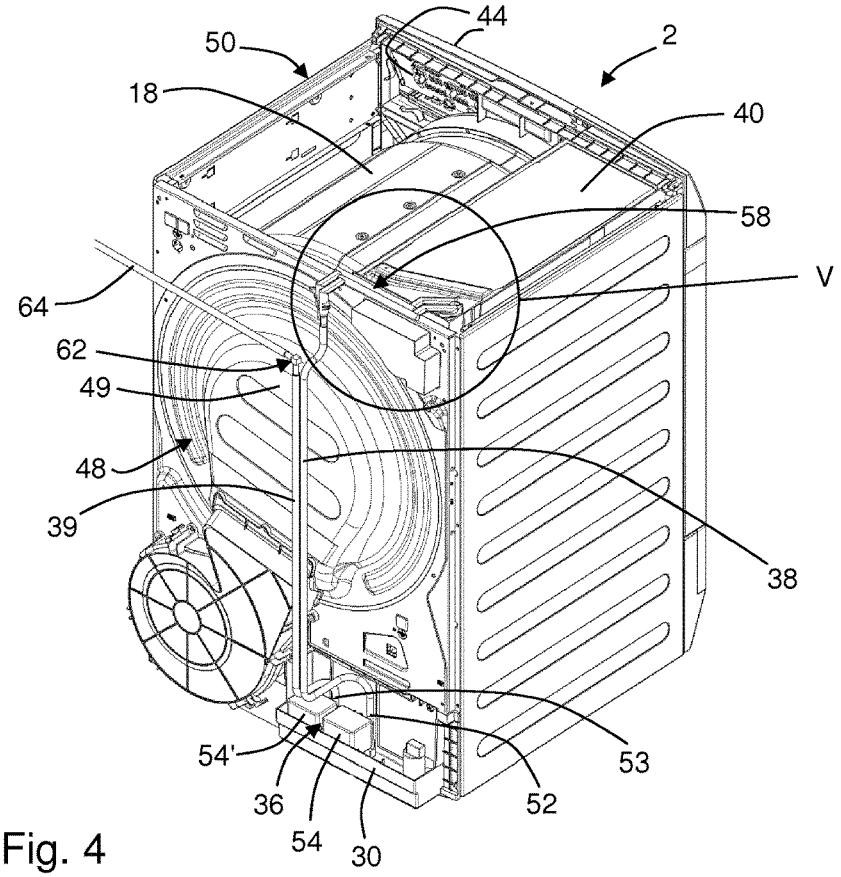

The dryer 2 according to FIG. 4 comprises a draining kit connection 62 for connecting the draining line 39 via a prolonging draining line section 64 to an external sink. The draining kit connection 62 is a kind of fluid coupling element for coupling the main section of the draining line 39 and the prolonging draining line section 64. The draining kit connection 62 can be mounted by specific mounting parts not explicitly shown at a rear wall 49 arranged at the backside 48 of the casing 50. If an external location (e.g. sink) is existing for discharging the condensate, the draining line can be selectively connected to this external location by using the draining kit connection 62 and the draining line section 64. If this is the case, a stub 66 arranged at the second inlet 61 of the re-feed connecting element 61 is not connected to the draining line 39 (FIG. 5). If the draining line 39 is selected to be connected to the re-feed connecting element 58, i.e. to the removable condensate reservoir 40, then the draining line 39 is connected to the stub 66 configured for mounting the line outlet 57 of the draining line 39 thereto (FIG. 3). The reason for selecting the latter connection can be for example a non-existing external location for discharging the condensate or a non-use of the draining kit connection 62. Alternatively, despite usage of the draining kit connection 62, the draining line 39 can be connected to the stub 66 by using the prolonging draining line section 64.

FIG. 6 is showing a fluid connection of the internal line 38 and the draining line 39 to the removable condensate reservoir 40 according to another embodiment. The sole pump 55 is connected to the valve inlet 70 of the diverter valve 37 by a pumping line 68. A first valve outlet 71 of the valve 37 is connected to the internal line 38 and a second valve outlet 72 of this valve 37 is connected to the draining line 39. In case the internal line 38 and the draining line 39 are connected both to the removable condensate reservoir 40, the connection system (FIG. 7) is in principle identical to the embodiment according to FIG. 2 and FIG. 3. In case the internal line 38 is connected to the removable condensate reservoir 40 and the draining line 39 is connected to an external location (FIG. 8 and FIG. 9), the connection system is in principle identical to the embodiment according to FIG. 4 and FIG. 5. The selection possibilities for connecting the draining line 39 described with regard to FIG. 2-FIG. 5 are also applicable for the embodiment according to FIG. 6-FIG. 9.

The re-feed connecting element 58 comprises suitable mounting means or elements (not explicitly shown) for selectively or removably fixing the line outlet 56 of the draining line 39 to the stub 66 in a predefined position. Furthermore, the re-feed connecting element 58 comprises a first feeding line 74 allocated to the internal line 38 and a second feeding line 75 allocated to the draining line 39. The first inlet 60 is part of the first feeding line 74 and the second inlet 61 is part of the second feeding line 75. Both inlets 60, 61 are arranged adjacent to the rear wall 49. The feeding lines 74, 75 each comprises several feeding line sections 76 arranged in horizontal direction and inclined to each other. The first feeding line 74 comprises a first feeding outlet 78 and the second feeding line 75 comprises a second feeding outlet 79. The feeding outlets 78, 79 each is in fluid connection with a reservoir inlet 80 of the removable condensate reservoir 40.

As already mentioned, the draining line 39 according to FIG. 2 and according to FIG. 6 is connected to the re-feed connecting element 58, respectively. According to FIG. 2, the flow path of the internal line 38 and the flow path of the draining line 39 are guided and arranged in parallel to the reservoir inlet 80. In the embodiment according to FIG. 6, the flow path of the internal line 38 and the flow path of the draining line 39 are fluidly in parallel to the reservoir inlet 80.

FIG. 10-FIG. 17 show several schematic designs/embodiments of a dryer for pumping condensate collected in the condensate collecting device 30. According to all these schematic designs, the dryer casing 50 contains a removable condensate reservoir 40, which is extractable from and insertable into a reservoir compartment along a horizontal removing direction 82. In case the condensate reservoir 40 is extracted from a reservoir compartment in the casing 50, a valve element 84 arranged at the reservoir compartment is in a closed state. Then a supply line 86 fluidly connected to the removable condensate reservoir 40 and to a cleaning arrangement 88 for cleaning a component 90 (e.g. a heat exchanger 10 or 12 according to FIG. 1 and/or fluff filter) does not receive cleaning liquid (condensate) for cleaning the cleaning arrangement 88.

According to FIG. 10-FIG. 13, the first pump 54 and the second pump 54' are used to selectively (under control of the control unit 42) pump the condensate through the internal line 38 and/or the draining line 39.

According to FIG. 14-FIG. 17, the sole pump 55 and the diverter valve 37 are used to selectively (under control of the control unit 42) pump the condensate through the internal line 38 and/or the draining line 39.

Figure 10:
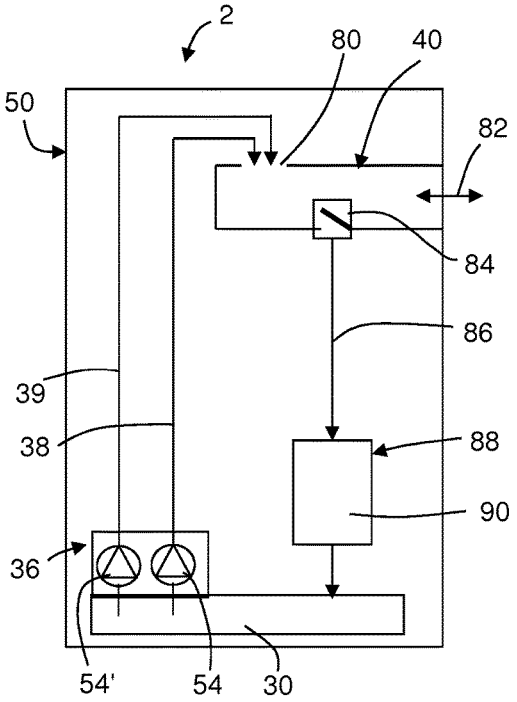
Figure 11:
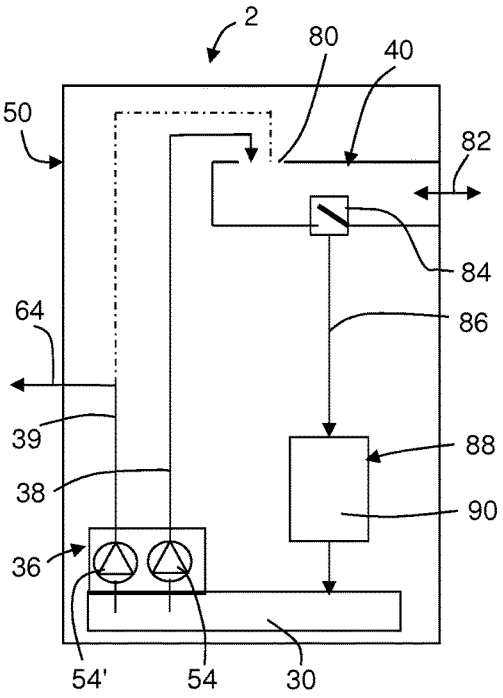

With regard to the arrangement of the internal line 38 and the draining line 39, the schematic design according to FIG. 10 and FIG. 11 corresponds in principle to the embodiments of a dryer 2 in FIG. 2 and FIG. 4. In contrast to a direct fluid connection between the internal line 38 and the draining line 39 to the reservoir inlet 80 shown in FIG. 10, it is alternatively possible to connect the internal line 38 and the draining line 39 to the reservoir inlet 80 indirectly by using the re-feed connecting element 58 according to FIG. 2 and FIG. 4.

Figure 12:
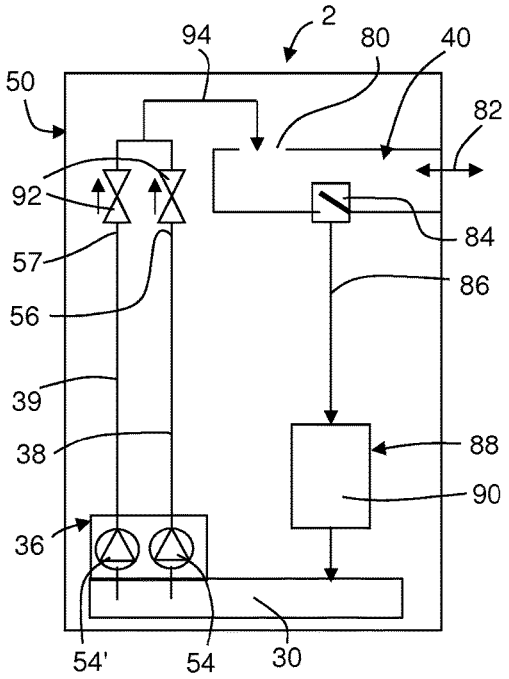
Figure 13:
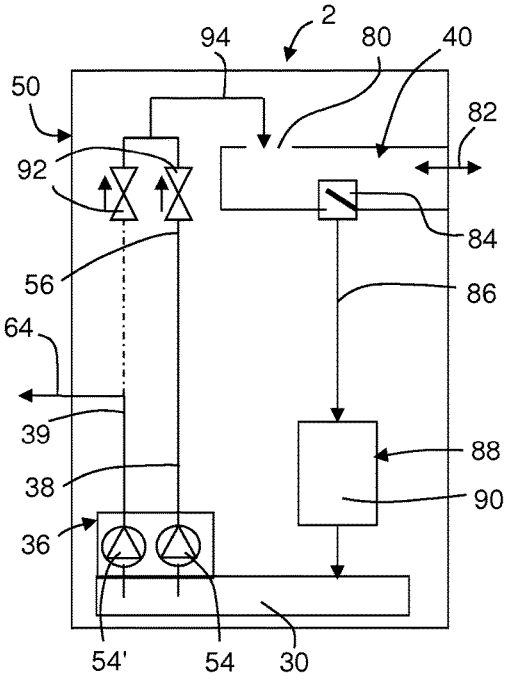

The schematic design according to FIG. 12 and FIG. 13 again shows an embodiment for connecting the draining line 39 selectively to the removable condensate reservoir 40 (FIG. 12) or to an external location outside the casing 50 (FIG. 13). In this embodiment, a non-return valve 92 is arranged between the line outlet 56 of the internal line 38 and the reservoir inlet 80 of the condensate reservoir 40. A further non-return valve 92 is arranged between the line outlet 57 of the draining line 39 and the reservoir inlet 80 of the condensate reservoir 40. The outlets of both non-return valves 92 are merged together thus achieving a joint fluid connection to the reservoir inlet 80. Alternatively, a re-feed connecting element 58 is arranged such that both non-return valves 92 are arranged between the line outlets 56, 57 of both lines 38, 39 (internal and draining line) and both inlets 60, 61 of the re-feed connecting element 58. This alternative with regard to the re-feed connecting element 58 is corresponding to the illustration in FIG. 16 and FIG. 17.

Figure 14:
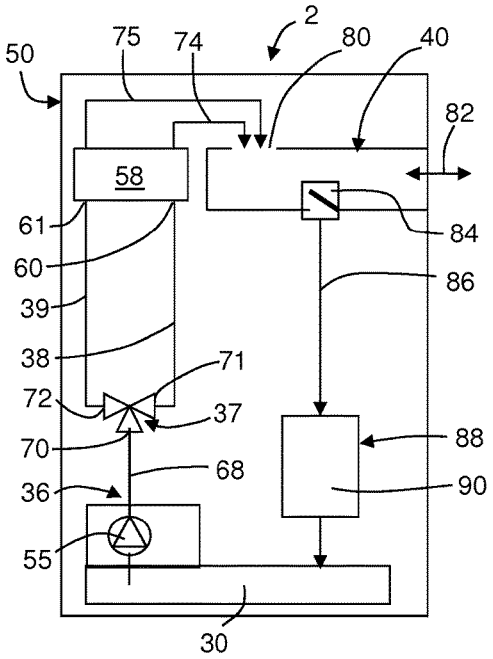
Figure 15:
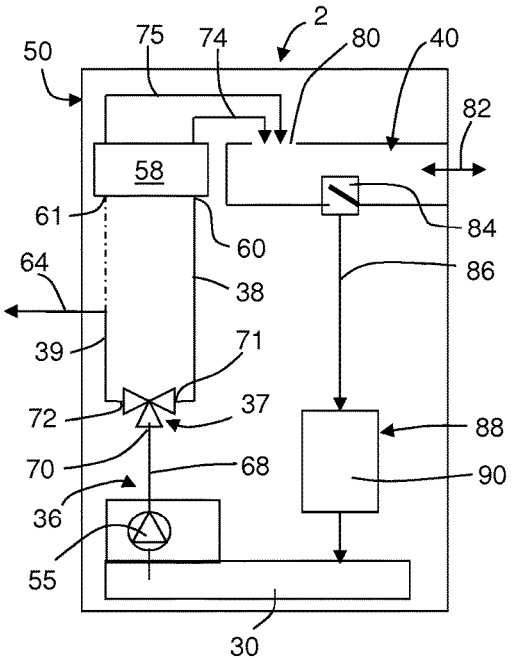

The schematic design according to FIG. 14 and FIG. 15 shows a further embodiment for connecting the draining line selectively to the removable condensate reservoir 40 (FIG. 14) or to an external location outside the casing 50 (FIG. 15). In this embodiment, the internal line 38 is arranged between the first valve outlet 71 of the diverter valve 37 and the first inlet 60 of the re-feed connecting element 58. The draining line 39 is arranged selectively between the second valve outlet 72 and the second inlet 61 of the re-feed connecting element 58 (FIG. 14) or between the second valve outlet 72 and an external location (FIG. 15). This schematic design according to FIG. 14 and FIG. 15 corresponds in principle to the embodiments of a dryer 2 in FIG. 6 and FIG. 8.

Figure 16:
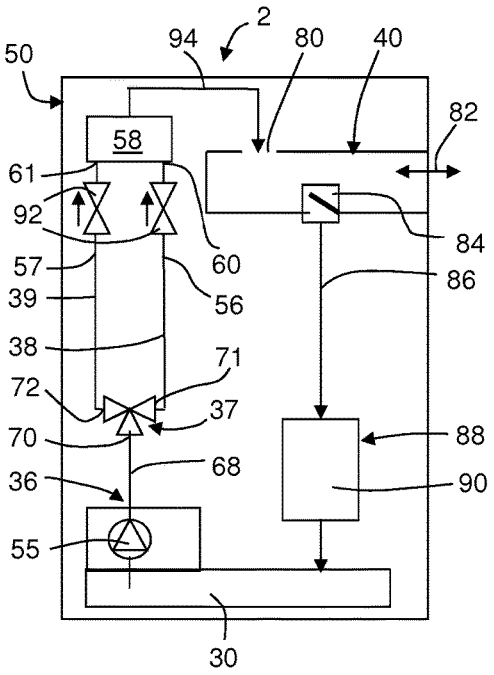
Figure 17:
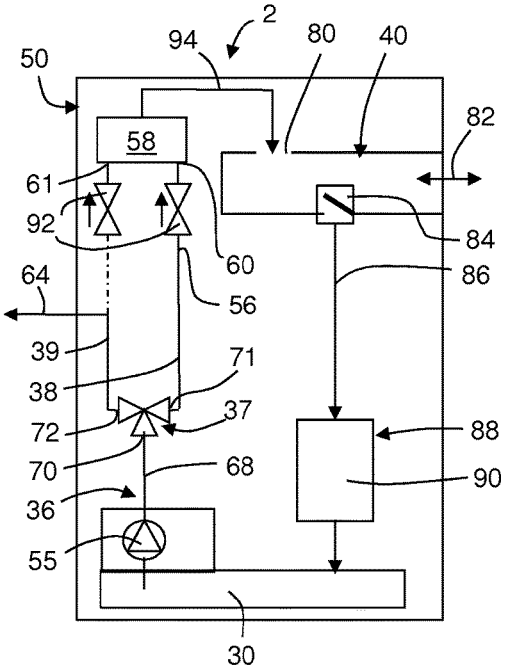

The schematic design of a dryer 2 according to FIG. 16 and FIG. 17 differs from the embodiment according to FIG. 14 and FIG. 15 mainly in arranging one non-return valve 92 between the internal line 38 and the first inlet 60 of the re-feed connecting element 58 and arranging one non-return valve 92 between the draining line 39 and the second inlet 61 of the re-feed connecting element 58. Furthermore, the feeding lines 74, 75 according to FIG. 14 and FIG. 15 are substituted by a joint line 94 in FIG. 16 and FIG. 17.

In an alternative embodiment (here not shown explicitly) the line outlet 56 of the internal line 38 is connected to a valve and the line outlet 57 of the draining line 39 is selectively connectable to this valve. The outlet of this valve is connected (directly or indirectly) to the reservoir inlet 80. This embodiment can be implemented for example by using the diverter valve 37 in a reverse direction.

Based on the embodiments according to FIG. 10-FIG. 17 it is also possible to implement the following embodiments:

- a non-return valve 92 or another valve type is part of the internal line 38, i.e. the internal line 38 comprises a non-return valve 92 or another valve type, and/or
- a non-return valve 92 or another valve type is part of the draining line 39, i.e. the draining line 39 comprises a non-return valve 92 or another valve type, and/or
- the re-feed connecting element 58 comprises at least one non-return valve 92 or another valve type.

Figure 18:
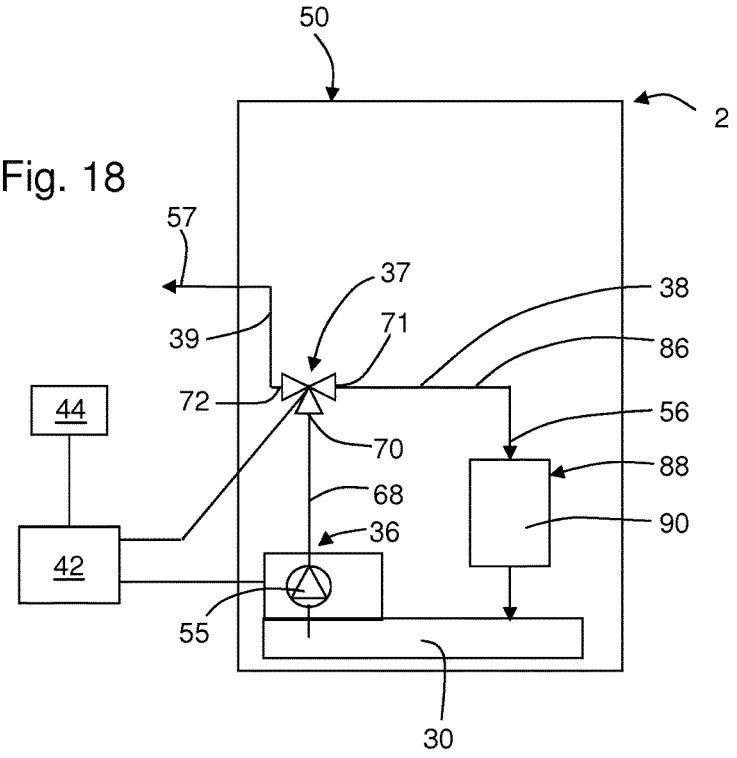

The schematic design of a dryer 2 according to FIG. 18 corresponds to the designs according to FIG. 14-FIG. 17 insofar, as again a pumping and feeding arrangement 36 having a sole pump 55 and a diverter valve 37 are arranged within the casing 50. Again, the draining line 39 is connected to the second valve outlet 72 and the internal line 38 is connected to the first valve outlet 71. In principle, controlling the diverter valve 37 (and subsequently pumping condensate through the draining line 39 and the internal line 38) can be made by the control unit 42 according to the aforementioned control modes. Unless otherwise indicated, all elements and components described above with respect to FIGS. 1 to 17 are also applicable in the dryer according this embodiment.

In contrast to FIG. 14-FIG. 17, the line outlet 56 of the internal line 38 is not connected to a removable condensate reservoir (not existing in the embodiment according to FIG. 18) but it is connected directly to the cleaning arrangement 88. Insofar, the internal line 38 can be denoted as a cleaning line or a supply line 86 for supplying cleaning liquid (i.e. condensate pumped from the condensate collecting device 30 to the supply line 86) to the cleaning arrangement 88. Preferably the draining line 39 has to be permanently connected to an external sink without the possibility to feed the condensate into a removable condensate reservoir. Preferably the dryer of this embodiment is a condenser-type dryer, a cabinet dryer or a washer-dryer, preferably it is a heat pump dryer.

Preferably, the line outlet 56 of the supply line 86 or the cleaning arrangement 88 comprises a nozzle element for guiding and distributing the supplied cleaning liquid.

In one embodiment, the cleaning arrangement 88 comprises a condensate receiving element for temporarily storing condensate guided through the supply line 86 to the cleaning arrangement 88. In another embodiment, the internal line 38 or supply line 86 is guiding the cleaning liquid/condensate to the component 90 without temporary storing the condensate or without providing temporary condensate storage in the flow-path from the pumping and feeding arrangement 36 to the component 90.

The cleaning arrangement 88 is allocated to a component 90 (e.g. fluff filter or heat exchanger 10, 12 according to FIG. 1) to be cleaned/washed/rinsed during a rinsing sequence, particularly for removing fluff from the component 90. During and partially with time delay after this sequence, the cleaning liquid flushed over the component 90 to be cleaned is guided back to the condensate collecting device 30 which can be also denoted as a non-removable tank or a bottom sump.

As mentioned above, preferably an external draining by pumping the condensate from the collecting device 30 through the draining line 29 is made at the end of a drying process (or any other process running in the dryer 2 or apparatus). Alternatively or additionally the external draining may be initiated when it is detected that the removable condensate reservoir 40 is full (or nearly full) and/or after each or after predefined ones of the cleaning cycles during which the component 40 is cleaned as described in the last paragraphs above. Draining the condensate after a cleaning cycle has the particular advantage that fluff removed from the component 40 is collected in the collecting device 30 and is then drained externally—at least if the user had connected the draining line 39 to the external sink. Thus fluff is efficiently removed out of the dryer 2.

Thus under the control of the control unit 42, the pumping and feeding arrangement 36 (as described above e.g. by controlling pump 54' or pump 55 and valve 37) drains the condensate or at least a portion of the condensate through the draining line 39 at, during and/or after one, arbitrary ones or each one of the following conditions:

- after, before and/or during a component cleaning cycle (if there are several cleaning cycles in one drying cycle, draining is preferably made after the last cleaning cycle or after each cleaning cycle or after a predefined number of cleaning cycles or after predefined ones of the cleaning cycles);
- towards or at the end of each drying or refreshment cycle (a cycle for drying or refreshing one laundry load); and
- when it is determined by the control unit that the removable condensate reservoir 40 is full or nearly full (see details below).

In a conventional condensate collecting dryer, a level switch or the pumping time is used to determine whether the removable condensate reservoir is full with condensate. When this full state is detected, the drying process is stopped and the user is requested to manually empty the removable condensate reservoir by an acoustic and/or visual signal.

Figure 19:
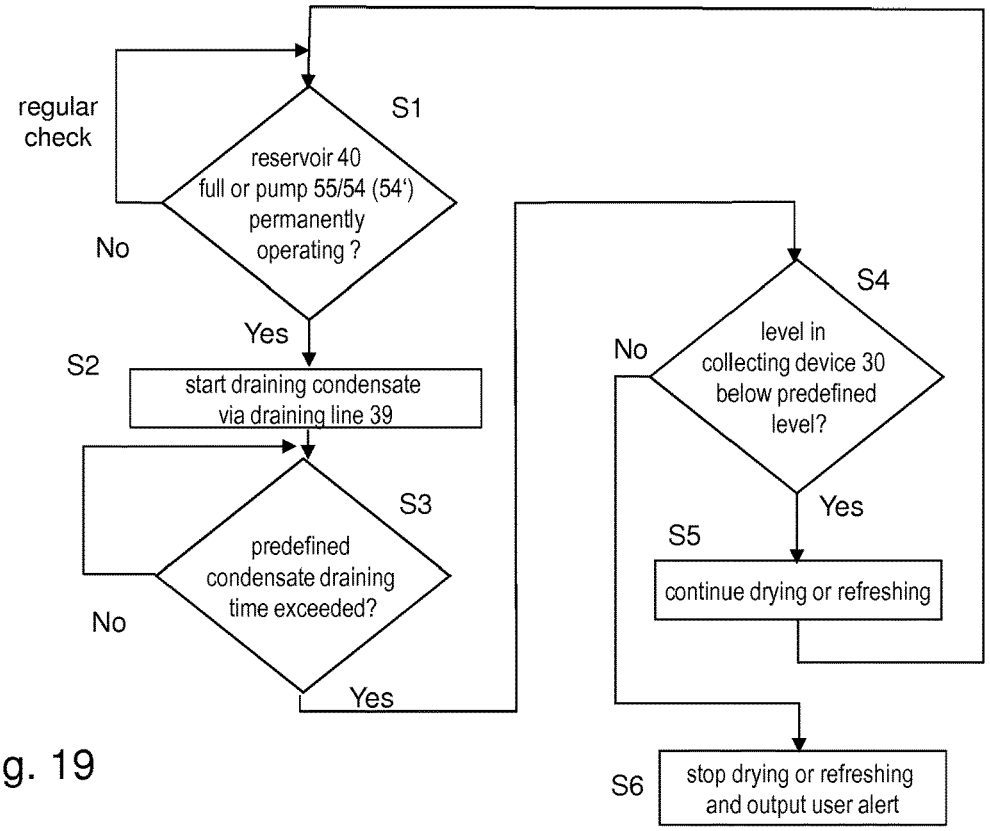

According to the above embodiments of the present invention, preferably the dryer—specifically the control unit 42 of the dryer 2—has no information whether the draining line 39 is connected to an external sink for external draining or not. Now it may happen that during the drying or refreshment cycle or during or between the cleaning cycles it is detected that the removable condensate reservoir 40 is full or is getting full and at the same time the drying cycle is not in a state (as mentioned above) in which the condensate or enough condensate is drained to the external sink (this state also includes the state where the draining line 39 is feeding the condensate to the removable condensate reservoir 40). To avoid interruption of the running drying or refreshment cycle as in the conventional dryer, the control unit 42 activates and implements a sub-routine for testing, whether condensate or a portion of the condensate can be removed to an external sink through the draining line 39—keeping in mind that per se the control unit 42 does not have this information. A flow diagram of the sub-routine is shown in FIG. 19.

A level detector (not shown) may be assigned to the removable condensate reservoir 40 to detect whether the reservoir is full. The signal of the level detector is supplied to the control unit 42 which then activates the sub-routing for removing the condensate to the external sink. Alternatively or additionally the dryer 2 is designed such that the removable condensate reservoir 40 has an overflow and an associated collector well (both not shown), wherein the latter one collects condensate that is pumped into the removable condensate reservoir and overflows due to the fact that the removable condensate reservoir is already full. The overflowing condensate is guided from the collector well (e.g. a reservoir housing in which the reservoir is inserted) down into the condensate collecting device 30. There the level sensor (not shown) that is used for activating the pumping and feeding arrangement 36 (via a signal to the control unit 42) already indicates that the condensate collecting device 30 needs draining. In consequence, the pumping activity of the pumping and feeding arrangement 36 results in a cycling of the condensate up to the removable condensate reservoir 40, where it overflows and returns back to the condensate collecting device 30. In a state where the draining line 39 is not connected to the external sink or where the standard control procedure does normally not provide pumping of the condensate through the draining line 39 connected to the external sink, the pumping and cycling of the condensate can be continued endlessly. Here, however, this extended pumping time (and/or the continued exceeding of the maximum level in the condensate collecting device 30) is used by the control unit 42 to determine that the removable condensate reservoir 40 is full. Thus the existence of a full level in the removable condensate reservoir is determined by one or both ways described above—shown as step S1 in FIG. 19.

Having determined that the removable condensate reservoir 40 is full, the sub-routine is activated by step S2, according to which the condensate is pumped exclusively or at least partially through the draining line 39 as described above. If the draining line 39 is connected to an external sink, condensate is removed from the dryer 2 and sooner or later the level sensor assigned to the condensate collecting device 30 indicates via a signal to the control unit 42 that the condensate collecting device 30 is emptied or the maximum level for activating the pumping and feeding arrangement 36 is undershot. The external pumping activity preferably is then continued a predefined time duration to pump out all of the condensate from the condensate collecting device 30 or to pump the condensate down to a predefined level (depending on the predefined time duration)—shown as step S3 in FIG. 19.

In the next Step S4 it is determined whether the condensate level in the condensate collecting device 30 is below a predefined level. For the detection in step S4 for example the start time of activating the pumping and feeding arrangement 36 is determined or the time since the start of the pumping and feeding arrangement 36. If this time of activation exceeds a predefined time duration ('no'), it is determined that the draining line 39 is not connected to the external sink. The predefined time duration is e.g. a time period in which normally a noticeable decline of the level in the condensate collecting device 30 can be observed via the associated level sensor.

If the condensate level in the condensate collecting device 30 falls below predefined level ('yes'), the control unit 42 implicitly determined that the draining line 39 is connected to an external sink. The effect is that the drying process needs not to be interrupted (step S5) and—as the level in the condensate collecting device 30 has decreased—new condensate from the drying process or from component cleaning cycles can be collected. The sub-routine is finished and the control flow is returned to step S1. Here again, if the exceeding of the level in the removable condensate reservoir is detected (if available) and the exceeding the level in the condensate collecting device 30 is detected, the sub-routine is activated again (each time it may happen).

On the other hand, if the condensate level in the condensate collecting device 30 does not fall ('no' in S4), it is implicitly determined that the draining line 39 is fluidly connected to the removable condensate reservoir. In case of this determination (no connection to external sink) the flow proceeds to step S6 where the drying process is stopped and the user is requested to manually empty the removable condensate reservoir 40. The request is for example indicated by a visual and/or acoustical alert, e.g. at the control panel 44.

REFERENCE NUMERAL LIST

| | |
|---|---|
| 2 | dryer |
| 4 | heat pump system |
| 6 | refrigerant loop |
| 8 | blower |
| 10 | first heat exchanger |
| 12 | second heat exchanger |
| 14 | compressor |
| 16 | expansion device |
| 18 | drum |
| 19 | laundry |
| 20 | process air channel |
| 20a | battery channel |
| 20b | rear channel |
| 20c | rising channel |
| 20d | front channel |
| 22 | filter element |
| 30 | condensate collecting device |
| 36 | pumping and feeding arrangement |
| 37 | diverter valve |
| 38 | internal line |
| 39 | draining line |

-continued

| | |
|---|---|
| 40 | removable condensate reservoir |
| 42 | control unit |
| 44 | operation panel |
| 45, 46 | arrows |
| 48 | backside |
| 49 | rear wall |
| 50 | casing |
| 52 | line inlet |
| 53 | line inlet |
| 54 | first pump |
| 54' | second pump |
| 55 | sole pump |
| 56 | line outlet |
| 57 | line outlet |
| 58 | re-feed connecting element |
| 59 | manifold |
| 60 | first inlet |
| 61 | second inlet |
| 62 | draining kit connection |
| 64 | draining line section |
| 66 | stub |
| 68 | pumping line |
| 70 | valve inlet |
| 71 | first valve outlet |
| 72 | second valve outlet |
| 74 | first feeding line |
| 75 | second feeding line |
| 76 | feeding line sections |
| 78 | first feeding outlet |
| 79 | second feeding outlet |
| 80 | reservoir inlet |
| 82 | removing direction |
| 84 | valve element |
| 86 | supply line |
| 88 | cleaning arrangement |
| 90 | component |
| 92 | non-return valve |
| 94 | joint line |
| A | process air flow |
| B | refrigerant flow |

The invention claimed is:

1. A laundry dryer comprising:

a casing, a laundry storing compartment arranged within the casing for receiving laundry to be dried by passing process air through the laundry storing compartment, a heat exchanger for dehumidifying the process air after passing the laundry storing compartment, a condensate collecting device for collecting condensate formed at the heat exchanger, a removable condensate reservoir for storing condensed water formed at the heat exchanger, a control unit for controlling the operation of the laundry dryer, and for controlling a pumping and feeding arrangement to pump condensate collected in the condensate collecting device selectively:

1) through an internal line to the removable condensate reservoir, 2) through a draining line, separate from the internal line, to the removable condensate reservoir in a configuration where the draining line is connected to the removable condensate reservoir, wherein a flow path of the draining line and a flow path of the internal line are fluidly in parallel, and 3) through the draining line to an external sink for draining the condensate outside the dryer casing in a configuration where the draining line is connected to the external sink.

2. The laundry dryer according to claim 1, wherein the control unit is adapted to control the pumping and feeding arrangement such that during a single drying operation a portion of the condensate is pumped through the internal line and a portion of the condensate is pumped through the draining line.

3. The laundry dryer according to claim 1, wherein the control unit is adapted to control the pumping and feeding arrangement such that at the end of a single drying operation or during or at the end of a rinsing sequence for rinsing a component of the dryer the condensate is pumped through the draining line.

4. The laundry dryer according to claim 1, wherein the removable condensate reservoir is fluidly connected to a cleaning arrangement adapted to supply condensate to a component of the laundry dryer for removing fluff.

5. The laundry dryer according to claim 4, wherein the dryer component to be cleaned by the condensate is one or more of: a heat exchanger, an evaporator, a fluff filter, and a process air channel section.

6. The laundry dryer according to claim 1, comprising a re-feed connecting element adapted for being connected to an outlet of the draining line for guiding the condensate pumped through the draining line into the removable condensate reservoir of the dryer.

7. The laundry dryer according to claim 6, wherein the re-feed connecting element comprises a manifold having a first inlet connected to the outlet of the internal line and a second inlet selectively connectable to the outlet of the draining line.

8. The laundry dryer according to claim 6, wherein a non-return valve or a valve is arranged between:

the outlet of the internal line and the first inlet, or the outlet of the draining line and the second inlet.

9. The laundry dryer according to claim 6, wherein the re-feed connecting element comprises a connector or a stub configured for mounting the outlet of the draining line thereto.

10. The laundry dryer according to claim 6, wherein the re-feed connecting element or a portion thereof is arranged at an outside wall or at the backside of the casing or is arranged in a receptacle of the casing or is arranged behind a removable cover arranged at an outside wall of the casing.

11. The laundry dryer according to claim 6, wherein the re-feed connecting element comprises a through-hole adapted to receive an end section of the draining line.

12. The laundry dryer according to claim 11, wherein the through-hole ends at a liquid guide for guiding the condensate pumped through the draining line to the removable condensate reservoir.

13. The laundry dryer according to claim 6, wherein the re-feed connecting element comprises one or more mounting elements for selectively or removably fixing the draining line in a predefined position for guiding the condensate pumped through the draining line into or towards the removable condensate reservoir.

14. The laundry dryer according to claim 6, wherein the re-feed connecting element comprises a feeding line having:

an inlet at or adjacent to a casing outer wall for being connected to the outlet of the draining line, and an outlet in fluid connection with an inlet of the removable condensate reservoir.

15. The laundry dryer according to claim 6, wherein, when the outlet of the draining line is connected to the re-feed connecting element, the flow path of the draining line and the flow path of the internal line are guided in parallel or fluidly in parallel to an inlet of the removable condensate reservoir.

16. The laundry dryer according to claim 1, wherein the outlet of the internal line is connected to a valve and the outlet of the draining line is selectively connectable to the valve, wherein the outlet of the valve is connected to the removable condensate reservoir.

17. The laundry dryer according to claim 1, wherein:

the internal line comprises a valve or a non-return valve, the draining line comprises a valve or a non-return valve, the re-feed connecting element comprises a valve or a non-return valve, the internal line and the draining line each comprises a valve or a non-return valve, or the internal line and the re-feed connecting element each comprises a valve or non-return valve.

18. The laundry dryer according to claim 1, wherein the pumping and feeding arrangement comprises:

a first pump connected to the internal line for pumping condensate from the condensate collection device through the internal line, and a second pump connected to the draining line for pumping condensate from the condensate collection device through the draining line.

19. The laundry dryer according to claim 1, wherein the pumping and feeding arrangement comprises a pump connected to the inlet of a valve wherein a first outlet of the valve is connected to the internal line and a second outlet of the valve is connected to the draining line.

20. The laundry dryer according to claim 1, wherein at least a portion of the internal line or at least a portion of the draining line is guided external to an outer wall or rear wall of the casing.

21. The laundry dryer according to claim 1, wherein the control unit is adapted to:

determine when the removable condensate reservoir is full or nearly full with condensate, activate a sub-routine or pumping condensate from the condensate collecting device through the draining line, and determine whether by the sub-routing an outside draining through the draining line can be effected, and stop a running drying or refreshment cycle, if it is determined that no outside draining can be effected, or continue a running drying or refreshment cycle, if it is determined that the outside draining can be effected.

22. A laundry dryer comprising:

a casing, a laundry storing compartment arranged within the casing for receiving laundry to be dried by passing process air through the laundry storing compartment, a heat exchanger for dehumidifying the process air after passing the laundry storing compartment, a condensate collecting device for collecting condensate formed at the heat exchanger, a draining line fluidly connected to an external drain in a first configuration for discharging condensate to the exterior of the dryer casing, and fluidly connected to a cleaning arrangement in a second configuration for supplying the condensate to a component of the dryer for removing fluff, an internal line, fluidly connected to the cleaning arrangement adapted to supply condensate to a component of the dryer for removing fluff, the internal line being separate and parallel to the draining line when the draining line is fluidly connected in the second configuration, a pumping and feeding arrangement for pumping condensate collected in the condensate collecting device selectively through the draining line and through the internal line, and a control unit for controlling the operation of the laundry dryer, the control unit being configured to control the pumping and feeding arrangement such that during a single drying operation a first portion of the condensate is pumped through the internal line to the cleaning arrangement and a second portion of the condensate is pumped through the draining line either: (1) to the external drain when the draining line is in the first configuration, or (2) to the cleaning arrangement when the draining line is in the second configuration.

23. The laundry dryer according to claim 22, wherein:

the cleaning arrangement comprises a condensate receiving element for temporarily storing condensate to be used in a component cleaning cycle for cleaning the component, or the internal line guides the condensate to the component to be cleaned without temporary storing the condensate or without providing a temporary condensate storage in the flow-path from the pumping and feeding arrangement to the component to be cleaned.

* * * * *